US011591174B2

(12) United States Patent
Izumiya et al.

(10) Patent No.: US 11,591,174 B2
(45) Date of Patent: Feb. 28, 2023

(54) PHYSICAL PROPERTY DETECTING DEVICE AND IMAGE FORMING SYSTEM

(71) Applicant: Konica Minolta, Inc., Tokyo (JP)

(72) Inventors: Yumiko Izumiya, Hachioji (JP); Satoshi Ogata, Hachioji (JP); Kazutoshi Yoshimura, Hino (JP)

(73) Assignee: Konica Minolta, Inc., Tokyo (JP)

( * ) Notice: Subject to any disclaimer, the term of this patent is extended or adjusted under 35 U.S.C. 154(b) by 550 days.

(21) Appl. No.: 16/660,286

(22) Filed: Oct. 22, 2019

(65) Prior Publication Data

US 2020/0122942 A1 Apr. 23, 2020

(30) Foreign Application Priority Data

Oct. 22, 2018 (JP) ..... JP2018-198350

(51) Int. Cl.
*B65H 7/02* (2006.01)
*G03G 15/00* (2006.01)

(52) U.S. Cl.
CPC ..... *B65H 7/02* (2013.01); *G03G 15/5029* (2013.01); *B65H 2511/13* (2013.01); *B65H 2511/135* (2013.01); *B65H 2515/10* (2013.01)

(58) Field of Classification Search
CPC ..... B65H 7/02; B65H 2515/10; B65H 2515/112; B65H 2511/13; B65H 2553/412; G03G 15/5029
USPC ..... 271/265.02
See application file for complete search history.

(56) References Cited

U.S. PATENT DOCUMENTS

| | | | | |
|---|---|---|---|---|
| 9,052,664 | B2 * | 6/2015 | Kuramochi | G03G 15/5029 |
| 10,474,080 | B2 * | 11/2019 | Hirota | G03G 15/55 |
| 10,901,356 | B2 * | 1/2021 | Mitsui | B65H 7/14 |
| 2016/0090256 | A1 | 3/2016 | Nakayama et al. | |

FOREIGN PATENT DOCUMENTS

| | | | |
|---|---|---|---|
| JP | 2015107841 | A | 6/2015 |
| JP | 2015-199578 | A | 11/2015 |
| JP | 2015205775 | A | 11/2015 |
| JP | 2017-007771 | A | 1/2017 |
| JP | 2017-030883 | A | 2/2017 |
| WO | 2013/190701 | A1 | 12/2013 |

OTHER PUBLICATIONS

First Office Action issued in related Chinese Patent Application No. 201910987585.3 dated Dec. 17, 2021 (17 pages).
Notice of Reasons for Refusal issued in related Japanese Patent Application No. 2018-198350 dated Jul. 12, 2022 (8 pages).
Office Action issued in counterpart Japanese Patent Application No. JP 2018-198350 dated Dec. 13, 2022, with translation (5 pages).

* cited by examiner

*Primary Examiner* — Jeremy R Severson
(74) *Attorney, Agent, or Firm* — Osha Bergman Watanabe & Burton LLP

(57) ABSTRACT

A physical property detecting device, includes: an insertion part that includes an insertion port through which a sheet is inserted and removed; a first physical property detector that detects a first physical property of the sheet in a non-nipping state; and a second physical property detector that nips the sheet and detects a second physical property of the sheet in a nipping state, wherein the first physical property detector and the second physical property detector are disposed at different positions in an insertion and removal direction of the sheet.

13 Claims, 8 Drawing Sheets

PHYSICAL PROPERTY DETECTING DEVICE AND IMAGE FORMING SYSTEM

CROSS-REFERENCE TO RELATED APPLICATION

The entire disclosure of Japanese patent Application No. 2018-198350, filed on Oct. 22, 2018, is incorporated herein by reference.

BACKGROUND

Technical Field

The present invention relates to a physical property detecting device and an image forming system.

Description of the Related Art

Conventionally, there is known an apparatus capable of detecting physical properties of a sheet such as a sheet by the user's operation. The user's operation includes an operation of inserting the sheet into the apparatus and an operation of pulling out the sheet from the apparatus after the physical properties of the sheet are detected.

For example, in JP-A-2015-107841 and JP-A-2015-205775, there is disclosed a configuration in which a sheet is nipped between a physical property detector and a mounting table biased toward the physical property detector by the biasing member, thus detecting physical properties of the sheet.

However, in the configuration described in JP-A-2015-107841 and JP-A-2015-205775, the sheet is inserted into a portion where the sheet is nipped between the physical property detector and the mounting table, which makes the workability poor for the user.

Further, depending on the variation in accuracy of the user's operation, a state in which the sheet is not disposed at the correct detection position may occur, so that there is a possibility that the detection accuracy by the physical property detector may be insufficient or the physical properties of the sheet may not be accurately detected. In addition, when the physical properties of the sheet cannot be accurately detected, the user has to repeat the operation of detecting the same sheet, which may further increase the user's operation burden.

SUMMARY

One or more embodiments of the present invention provide a physical property detecting device and an image forming system capable of improving the user's workability and the detection accuracy of the physical properties of a sheet.

A physical property detecting device of one or more embodiments of the present invention comprises: an insertion part that is able to insert and remove a sheet from an insertion port; a first physical property detector that detects a first physical property of the sheet in a state of not nipping the sheet; and a second physical property detector that is able to nip the sheet and detects a second physical property of the sheet in a state of nipping the sheet, wherein the first physical property detector and the second physical property detector are disposed at different positions in an insertion and removal direction of the sheet in the insertion part.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION

Figure 1:
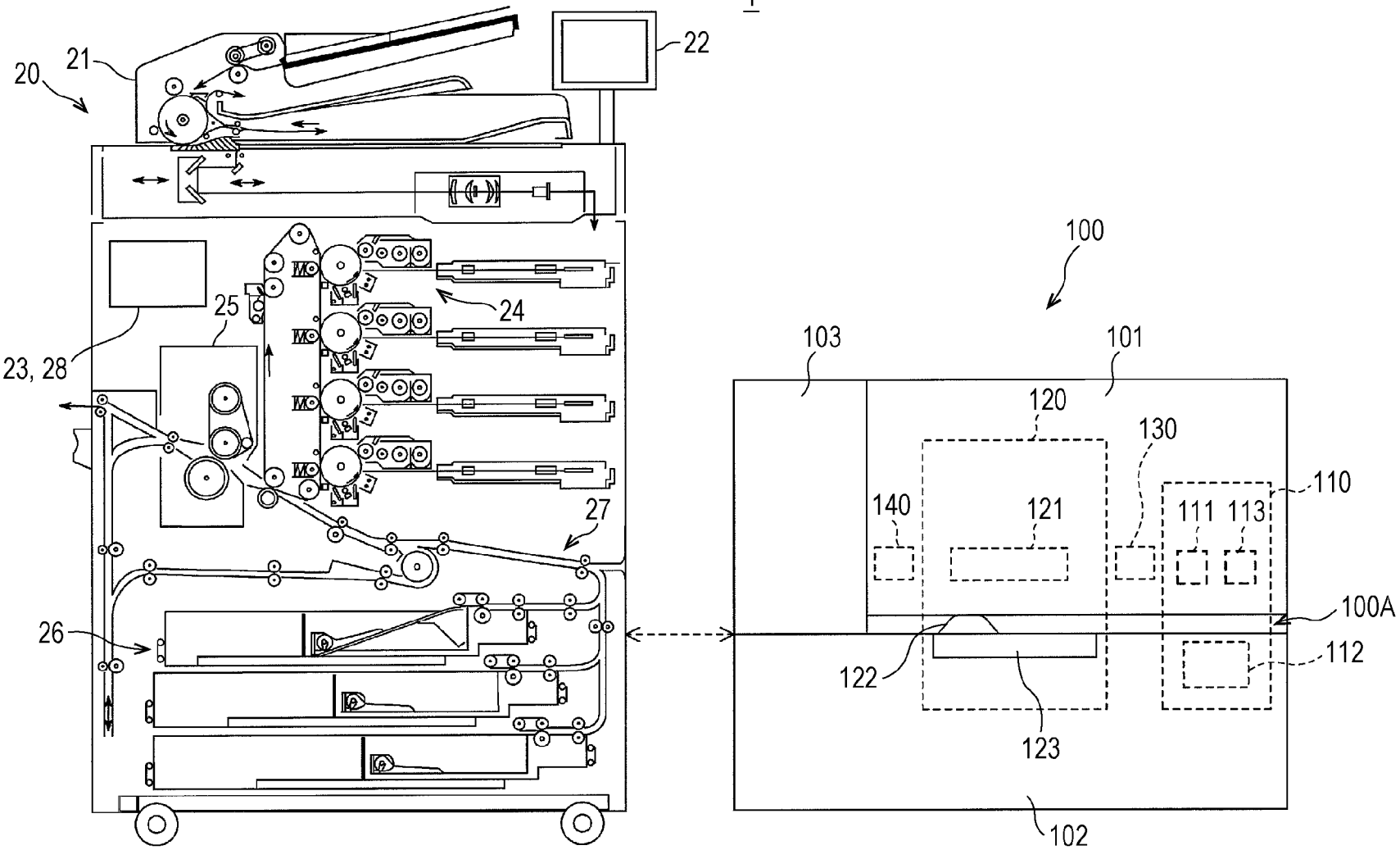
FIG. 1 is a diagram showing an entire configuration of an image forming system according to one or more embodiments.

Hereinafter, embodiments of the present invention will be described with reference to the drawings. However, the scope of the invention is not limited to the disclosed embodiments. FIG. 1 is a diagram showing an entire configuration of an image forming system 1 in one or more embodiments. As shown in FIG. 1, the image forming system 1 includes an image forming device 20 and a physical property detecting device 100 capable of communicating with the image forming device 20. In the following, an example in which the sheet is a sheet will be described.

The image forming device 20 is an intermediate transfer type color image forming device using an electrophotographic process technology. The image forming device 20 employs a vertical tandem system in which photosensitive drums corresponding to four colors of CMYK are arranged in series in the traveling direction (vertical direction) of the intermediate transfer belt in the image forming device 20, and toner images of respective colors are sequentially transferred to the intermediate transfer belt in one procedure. That is, the image forming device 20 transfers (primarily transfers) toner images of Y (yellow), M (magenta), C (cyan), and K (black) formed on the photosensitive drum onto the intermediate transfer belt, and after superimposing toner images of four colors on the intermediate transfer belt, an image is formed by transferring (secondary transferring) onto a sheet.

The image forming device 20 includes an image reader 21, an operation display 22, an image processor 23, an image forming part 24, a fixing part 25, a sheet feeder 26, a sheet conveyor 27, and an image formation controller 28.

The image formation controller 28 includes a central processing unit (CPU), a read only memory (ROM), a random access memory (RAM), and the like. The CPU reads out a program corresponding to the processing content from the ROM, expands it in the RAM, and centrally controls the operation of each block of the image forming device 20 in cooperation with the expanded program.

The image reader 21 includes an auto document feeder (ADF), a document image scanning device (scanner), and the like. In the image reader 21, a document conveyed from the auto document feeder on the contact glass or a document placed on the contact glass is read by the document image scanning device, and input image data is generated.

The operation display 22 is configured of, for example, a liquid crystal display (LCD) with a touch panel, and functions as a display and an operation part.

The image processor 23 performs various types of correction processing such as gradation correction, color correction, and shading correction according to initial setting or user setting, and digital image processing such as compression processing on the input image data. The image forming part 24 is controlled based on the image data subjected to these processing.

The image forming part 24 forms an image with each color toner of Y component, M component, C component, and K component based on the image data. The image forming part 24 includes a photosensitive drum, a charging device, an exposure device, a developing device, and an intermediate transfer device.

In the image forming part 24, the surface of the photosensitive drum is uniformly charged by the charging device. An electrostatic latent image is formed on the surface of the photosensitive drum by irradiation of a laser beam based on image data onto the charged photosensitive drum by the exposure device. Then, the developing device supplies toner to the photosensitive drum on which the electrostatic latent image is formed, whereby the electrostatic latent image is visualized to form a toner image. The toner image is transferred to the sheet by an intermediate transfer device having an intermediate transfer belt or the like.

The fixing part 25 includes an upper fixing part having a fixing surface side member disposed on the fixing surface (surface on which a toner image is formed) side of the sheet, a lower fixing part having a back surface side supporting member disposed on the back surface (surface opposite to the fixing surface) side of the sheet, a heating source, and the like. The back surface side supporting member is pressed against the fixing surface side member to thereby form a fixing nip for nipping and conveying the sheet. The fixing part 25 fixes the toner image on the sheet by heating and pressurizing the sheet on which the toner image has been secondarily transferred and which has been conveyed at the fixing nip.

The sheet feeder 26 has a plurality of (three stages in FIG. 1) sheet feeding trays. In the sheet feeding trays, sheets (standard sheets, special sheets) identified based on basis weight, size (length, width) and the like are accommodated for each preset type.

The sheet conveyor 27 conveys the sheet fed from the sheet feeder 26 to the image forming part 24. When the sheet passes through a secondary transfer part of the image forming part 24, the toner images on the intermediate transfer belt are collectively secondarily transferred onto one side (front side) of the sheet, and a fixing process is performed in the fixing part 25. The sheet on which the image is formed is discharged to the outside of the machine by a discharge roller. When an image is formed on both sides of the sheet, the sheet on which the image is formed on the front side is conveyed to the conveyance path for the back side, and is conveyed to the image forming part 24 in a reversed state.

The physical property detecting device 100 is configured to be able to detect physical properties of a sheet by the user inserting and removing the sheet at an insertion part 100A. The physical property detecting device 100 is configured of an upper side 101, a lower side 102, and an opposing part 103.

The upper side 101 is a portion of the casing constituting the physical property detecting device 100, which is the upper portion of the insertion part 100A. The lower side 102 is a portion lower than the insertion part 100A in the casing constituting the physical property detecting device 100.

The insertion part 100A is a space sandwiched between the upper side 101 and the lower side 102 in the vertical direction, and extends in a direction for inserting and removing a sheet (hereinafter, referred to as "insertion and removal direction"). The insertion and removal direction is the left and right direction in FIG. 1.

The insertion part 100A is opened on the right side, and this opening portion is an insertion port for a sheet. The width of the insertion part 100A in the vertical direction is larger than the thickness of the sheet so that the sheet can be inserted from the insertion port. Thus, it is possible to smoothly insert and remove the sheet into and from the insertion part 100A.

The opposing part 103 is a portion located at the deepest side in the insertion part 100A, and contacts the leading end of the sheet inserted into the insertion part 100A. When the leading end of the sheet comes in contact with the opposing part 103, the user can determine that the leading end of the sheet has been inserted to the deepest position of the physical property detecting device 100.

Figure 2:
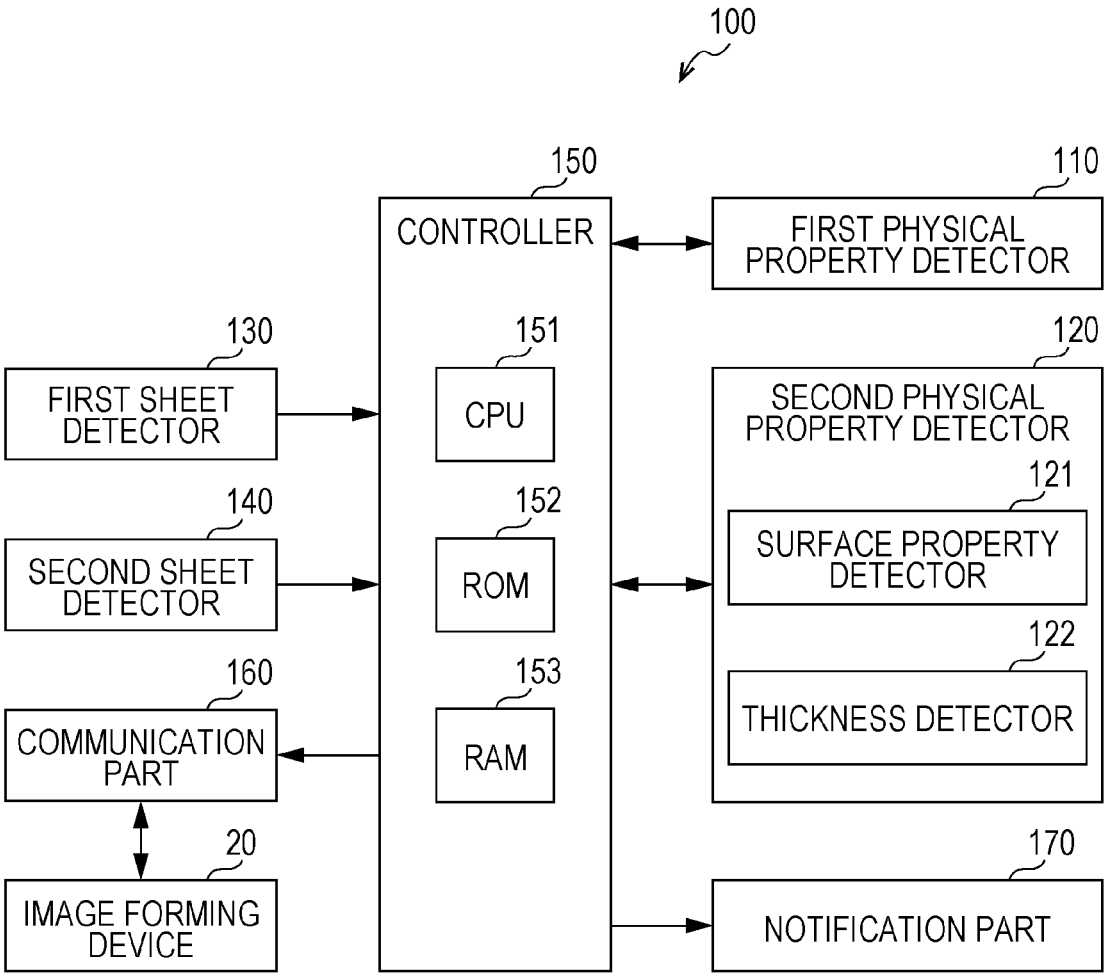
FIG. 2 is a diagram showing a main part of a control system of a physical property detecting device according to one or more embodiments.

As shown in FIGS. 1 and 2, the physical property detecting device 100 includes a first physical property detector 110, a second physical property detector 120, a first sheet detector 130, a second sheet detector 140, a controller 150, a communication part (communicator) 160, and a notification part 170.

The first physical property detector 110 is a detector that detects the basis weight of the sheet without nipping the sheet, and includes a first light emitter 111, a second light emitter 112, and a light receiver 113. The basis weight corresponds to the "first physical property" of one or more embodiments of the present invention.

The first physical property detector 110 detects the basis weight of a sheet existing at a position corresponding to the first physical property detector 110 in the insertion part 100A, based on a light receiving signal of the light receiver 113 when the first light emitter 111 and the second light emitter 112 emit light.

Figure 3:
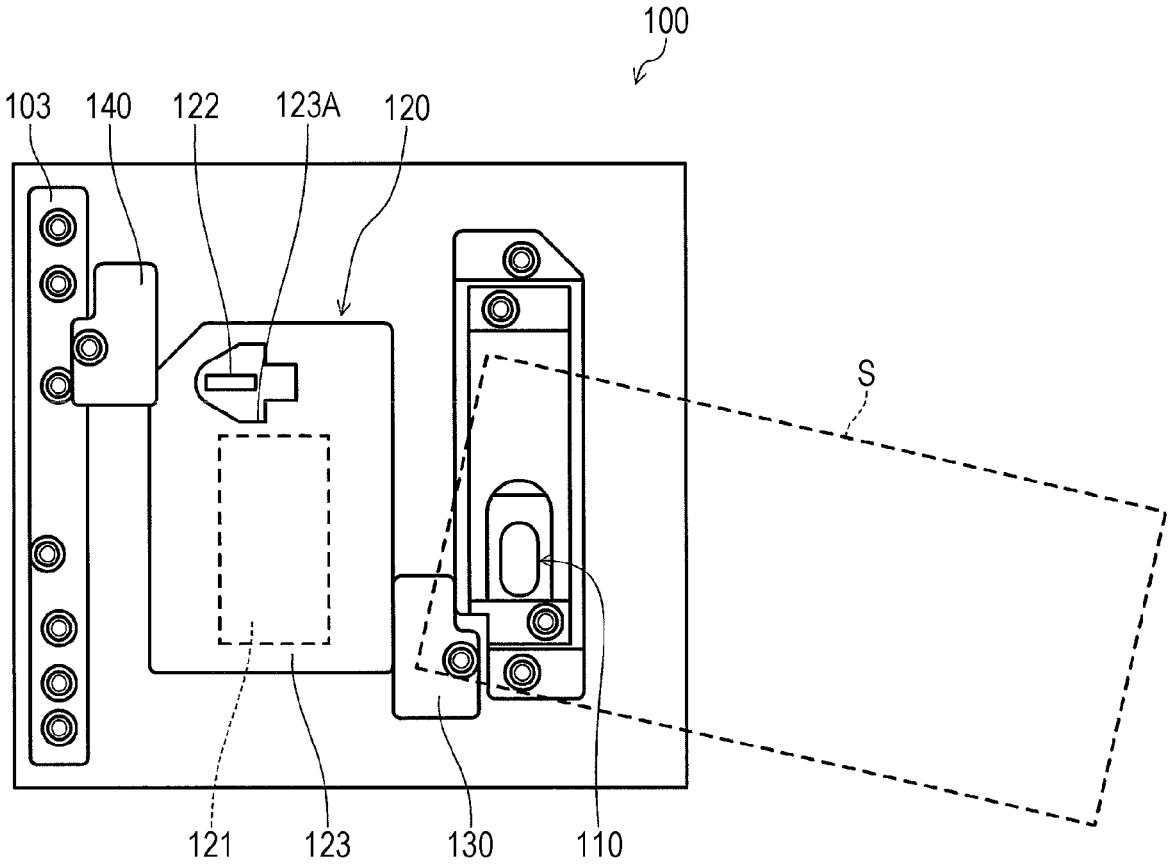
FIG. 3 is a top view of the physical property detecting device according to one or more embodiments.

Further, as shown in FIG. 3, the first physical property detector 110 is disposed at a position where the physical properties of a sheet S can be detected even when the sheet S is inclined and disposed at the insertion port of the insertion part 100A. As a result, even if the sheet S is inclined and disposed due to the variation in accuracy of the user's operation, the physical properties of the sheet S can be detected by the first physical property detector 110. The example shown in FIG. 3 shows an example in which the sheet S is disposed in the most inclined state within a range detectable by the first sheet detector 130 described later.

As shown in FIG. 3, the second physical property detector 120 detects the surface properties and thickness of the sheet while nipping the sheet. The surface properties and thickness of the sheet correspond to the "second physical property" of one or more embodiments of the present invention. The second physical property detector 120 is disposed further to the back than the first physical property detector 110 in the insertion part 100A. In other words, the first physical property detector 110 is disposed closer to the insertion port than the second physical property detector 120 in the insertion part 100A. The second physical property detector 120 includes a surface property detector 121, a thickness detector 122, and a pressing plate 123.

The surface property detector 121 is provided on the upper side 101, and has a light emitter and a light receiver. The surface property detector 121 detects the surface properties of a sheet located at the position corresponding to the surface property detector 121 in the insertion part 100A.

The thickness detector 122 is, for example, a rotary encoder, and is provided so as to protrude into the insertion part 100A at a position corresponding to the surface property detector 121 of the lower side 102. The thickness detector 122 is in contact with the upper side 101, and the nip state with the upper side 101 is maintained. The sheet is nipped at a nip part between the thickness detector 122 and the upper side 101, whereby the thickness detector 122 detects the thickness of the sheet.

The thickness detector 122 corresponds to the "first detector" in one or more embodiments of the present invention. The upper side 101 corresponds to the "first nipping member" in one or more embodiments of the present invention.

The pressing plate 123 is provided at a position corresponding to the surface property detector 121 in the lower side 102, and is configured to be able to advance and retract with respect to the upper side 101. Specifically, the pressing plate 123 is supported by, for example, rails (not shown) extending in the vertical direction, and is configured to advance and retract with respect to the upper side 101 by driving a cam (not shown) and the like.

The pressing plate 123 advances into the insertion part 100A from a position retracted from the insertion part 100A in the lower side 102, and nips the sheet between the upper side 101 and the pressing plate 123 in the insertion part 100A. That is, the upper side 101 and the pressing plate 123 can be transitioned between the non-nipping state of not nipping the sheet and the nipping state of nipping the sheet.

Thus, nipping the sheet between the upper side 101 and the pressing plate 123 at the position corresponding to the surface property detector 121 in the insertion part 100A allows the surface property detector 121 to detect the surface properties of the sheet. By nipping the sheet between the pressing plate 123 and the upper side 101 and detecting the surface properties of the sheet, it becomes possible to accurately perform the detection in the surface property detector 121 without the influence of work noise or the like.

The surface property detector 121 corresponds to the "second detector" of one or more embodiments of the present invention. The upper side 101 corresponds to the "second nipping member" of one or more embodiments of the present invention, and the pressing plate 123 corresponds to the "third nipping member" of one or more embodiments of the present invention. The upper side 101 and the pressing plate 123 correspond to the "nipping mechanism" of one or more embodiments of the present invention.

The pressing plate 123 is disposed at a position overlapping the thickness detector 122 in the insertion and removal direction. As shown in FIG. 3, an opening 123A is formed in a portion corresponding to the thickness detector 122 of the pressing plate 123. Thus, regardless of the thickness detector 122, the pressing plate 123 can freely move up and down.

The first sheet detector 130 is provided between the first physical property detector 110 and the second physical property detector 120, and detects presence of the sheet S located at a position corresponding to the first sheet detector 130, that is, in the detection range of the first physical property detector 110.

The first sheet detector 130 is disposed on one end side (lower end side in FIG. 3) in the width direction (vertical direction in FIG. 3) of the sheet S. With such an arrangement, even when the sheet S is inclined and disposed at the insertion port of the insertion part 100A, the first sheet detector 130 can detect the presence of the sheet S.

The second sheet detector 140 is provided on the back side of the second physical property detector 120 and on the opposite side of the insertion port in the insertion part 100A, and detects the sheet S located at a position corresponding to the second sheet detector 140, that is, in the detection range of the second physical property detector 120.

The second sheet detector 140 is disposed on the other end side (upper end side in FIG. 3) in the width direction of the sheet S. Therefore, the second sheet detector 140 is disposed diagonally to the first sheet detector 130 with the second physical property detector 120 interposed therebetween. Thus, the position of the sheet S in the width direction in the insertion part 100A can be made accurate, so that the detection accuracy by the second physical property detector 120 can be improved.

The controller 150 includes a central processing unit (CPU) 151, a read only memory (ROM) 152, a random access memory (RAM) 153, and the like. The CPU 151 reads out a program corresponding to the processing content from the ROM 152, develops it in the RAM 153, and cooperates with the developed program to centrally control the operation of each block of the physical property detecting device 100. The CPU may be implemented by one or multiple hardware processors.

When the first sheet detector 130 detects the presence of the sheet, the controller 150 controls the first physical property detector 110 to start detection of the physical properties of the sheet. The controller 150 corresponds to the "first controller" in one or more embodiments of the present invention.

As shown in FIG. 3, the sheet S may be disposed inclined with respect to the physical property detecting device 100 due to the variation in the operation of disposing the sheet S by the user. In this case, for example, if the first sheet detector 130 is located closer to the insertion port than the first physical property detector 110, even if the first sheet detector 130 detects the presence of the sheet S, the sheet S may not be normally disposed on the first physical property detector 110.

Therefore, when detection by the first physical property detector 110 is started upon detection of the presence of the sheet S by the first sheet detector 130, the detection accuracy of physical properties of the sheet S in the first physical property detector 110 may decrease.

However, in one or more embodiments, since the first sheet detector 130 is located further to the back than the first physical property detector 110, when the first sheet detector 130 can detect the presence of the sheet S, the sheet S is reliably disposed in the detection range of the first physical property detector 110. Therefore, the detection accuracy in the first physical property detector 110 can be improved.

When the first sheet detector 130 and the second sheet detector 140 detect the presence of the sheet S, the controller 150 controls the surface property detector 121 to start detection of the physical properties of the sheet.

Specifically, when the first sheet detector 130 and the second sheet detector 140 detect the presence of the sheet S, the controller 150 causes the pressing plate 123 to advance into the insertion part 100A so as to nip the sheet S between the upper side 101 and the pressing plate 123. In other words, the controller 150 controls the pressing plate 123 to transition from the non-nipping state to the nipping state. The controller 150 corresponds to the "second controller" in one or more embodiments of the present invention.

Then, after the sheet S is nipped by the upper side 101 and the pressing plate 123, the controller 150 starts the detection by the surface property detector 121.

When the sheet S is detected by the first sheet detector 130 and the second sheet detector 140, it can be understood that the sheet S is reliably disposed in the detection range of the surface property detector 121. Therefore, when detection by the surface property detector 121 is started upon detection of the sheet S by the first sheet detector 130 and the second sheet detector 140, detection accuracy of physical properties of the sheet S by the second physical property detector 120 can be improved.

In addition, since the pressing plate 123 is advanced to the insertion part 100A when the sheet S enters the detection range of the second physical property detector 120, the sheet S can be smoothly inserted into the insertion part 100A in comparison with the configuration in which the sheet is pushed into a place always nipped by the pressing plate 123. As a result, the efficiency of operation by the user can be improved.

Further, when the detection of physical properties of the sheet S is completed, the controller 150 controls the pressing plate 123 so as to transition from the nipping state to the non-nipping state.

Thus, when the detection of physical properties of the sheet S is completed, the user can smoothly pull out the sheet S from the insertion part 100A.

The completion of detection of the physical properties of the sheet S may be, for example, the number of times of detection by the first physical property detector 110. That is, after the controller 150 detects the sheet S a predetermined number of times by the first physical property detector 110, the controller 150 may control the pressing plate 123 so as to transition from the nipping state to the non-nipping state. The predetermined time is, for example, five times, and may be set to the number of times of detection required by the first physical property detector 110.

Thereby, each physical property detector can ensure the required detection time. The detection of physical properties of the sheet S may be completed when the detection of the second physical property detector 120 is completed.

Further, the controller 150 may determine the type of the sheet S based on the detection results of the first physical property detector 110 and the second physical property detector 120. By doing this, it is possible to quickly inform the user of the type of sheet S. The controller 150 corresponds to the "determination part" of one or more embodiments of the present invention.

In addition, the controller 150 may sequentially store the detection results of the first physical property detector 110 and the second physical property detector 120 in a storage part (not shown). The timing at which the detection result of the thickness detector 122 is stored may be, for example, the timing when the movement of the sheet S is completely stopped, that is, when the sheet S is nipped by the pressing plate 123.

The communication part 160 is configured of, for example, a communication control card such as a LAN (Local Area Network) card. The controller 150 transmits and receives various data to and from the image forming device 20 connected to a communication network such as a LAN via the communication part 160. The controller 150 transmits information on physical properties of the sheet S to the image forming device 20, for example.

The information on the physical property may be the detection results of the first physical property detector 110 and the second physical property detector 120, or may be the information of the type of the sheet S determined based on the detection results. The detection results of the first physical property detector 110 and the second physical property detector 120 may be a value read from the storage part described above, or may be a detected value as it is.

The image formation controller 28 causes the storage part (not shown) or the like to store the received information on the physical properties. The image formation controller 28 performs control related to image formation based on the information. As described above, by exchanging data between the physical property detecting device 100 and the image forming device 20, it is possible to perform image formation control based on accurate sheet information.

The notification part 170 notifies the user of the detection state in the physical property detecting device 100. The detection state, for example, includes a first state in which the sheet S is detected, and a second state in which some abnormality occurs during detection of the sheet S.

The first state includes, for example, a state in which the sheet S is detected by the first physical property detector 110, a state in which the sheet S is detected by the second physical property detector 120, and the like. Further, as the first state, the state may be from the start of the advancing operation by the pressing plate 123 to the completion of the retracting operation by the pressing plate 123.

The second state, for example, includes a state in which the sheet S cannot be normally detected, such as a failure or a detection error of the first physical property detector 110 and the second physical property detector 120.

The method of notification includes, for example, sound such as sounding an alarm, sound such as voice guidance, and visual display such as lighting a lamp, displaying a detection state on a display, and the like.

Further, the controller 150 may control the notification part 170 to notify the user by a method that can distinguish the state according to the detection state. By doing this, it is possible to easily determine what kind of detection state the user is.

The operation of the physical property detecting device 100 configured as described above will be described. FIGS. 4A, 4B, 5, 6A, 6B, and 7 are diagrams for explaining the operation of the physical property detecting device 100.

As shown in FIG. 3, when the user inserts the sheet S into the insertion part 100A and the sheet S reaches the position of the first sheet detector 130, the first sheet detector 130 detects the presence of the sheet S. When the first sheet detector 130 detects the presence of the sheet S, the control of the controller 150 causes the first physical property detector 110 to start detection of the physical properties of the sheet S.

Figure 4A:
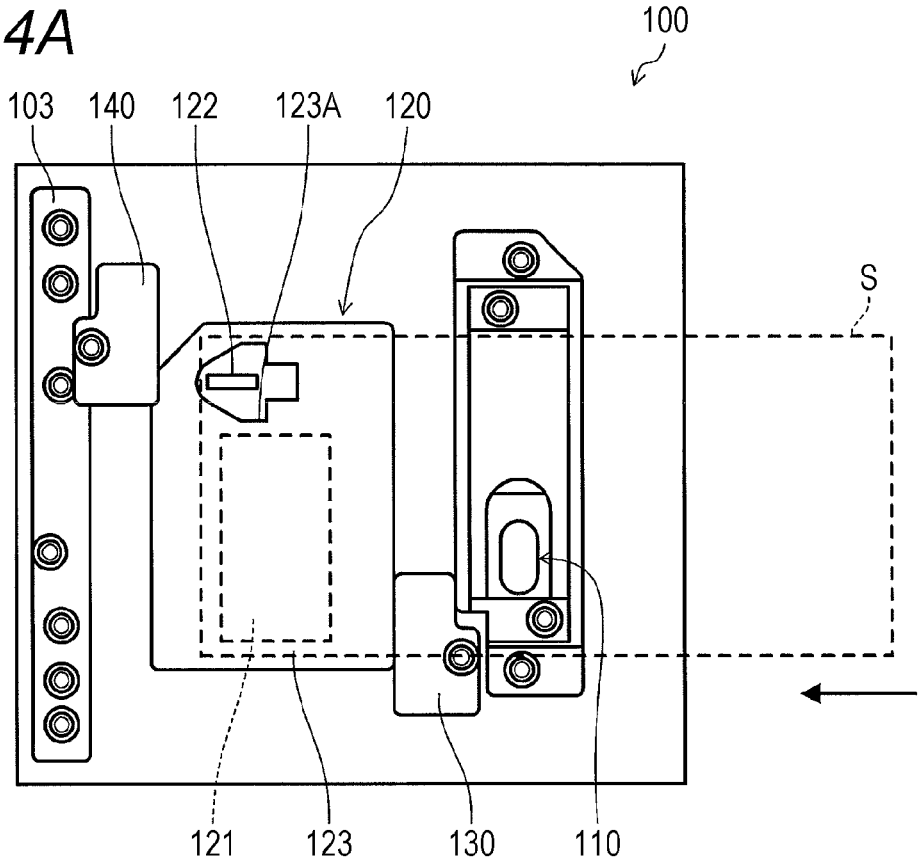
FIG. 4A is a view for explaining the operation of the physical property detecting device according to one or more embodiments.
Figure 4B:
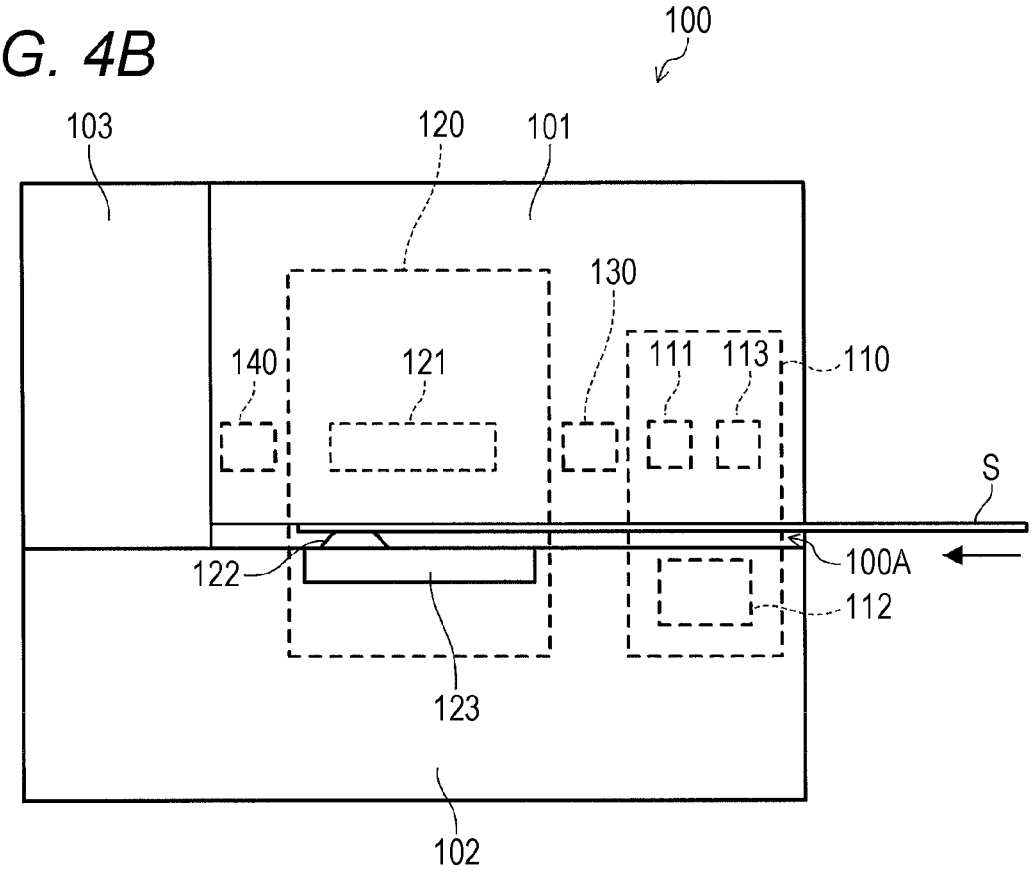
FIG. 4B is a diagram for explaining the operation of the physical property detecting device according to one or more embodiments.

As shown in FIGS. 4A and 4B, when the user advances the sheet S further back and the sheet S passes through the nip part between the thickness detector 122 and the upper side 101, the thickness detector 122 starts detection of physical properties of the sheet S.

Figure 5:
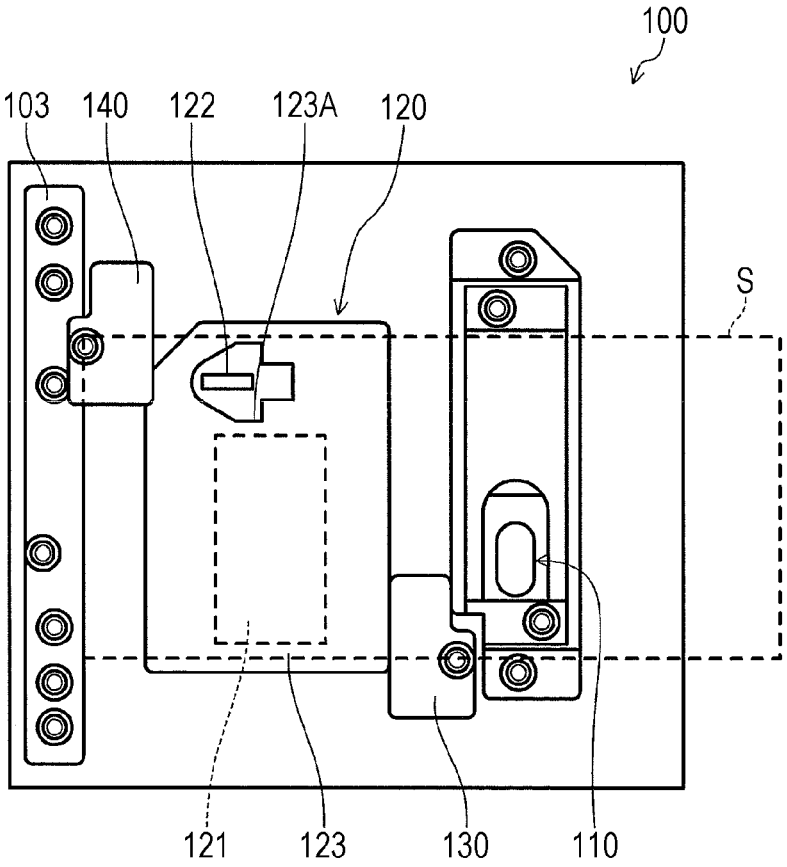
FIG. 5 is a view for explaining the operation of the physical property detecting device according to one or more embodiments.
Figure 6A:
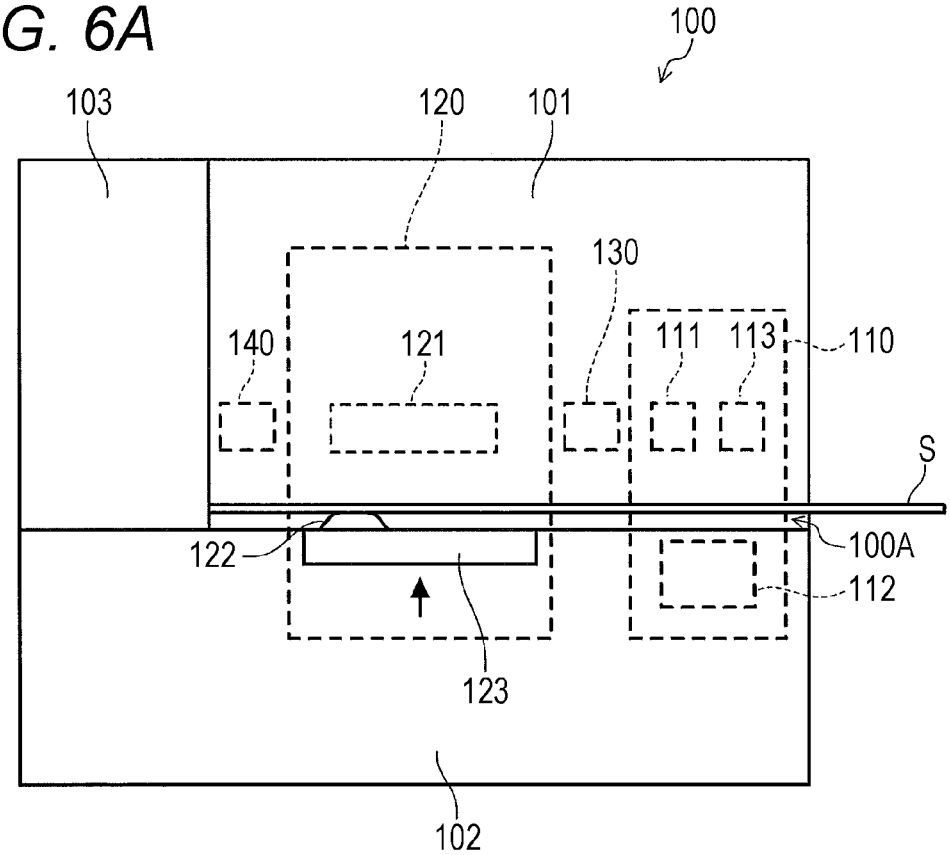
FIG. 6A is a diagram for explaining the operation of the physical property detecting device according to one or more embodiments.

As shown in FIG. 5, when the user advances the sheet S further back and the sheet S reaches the position of the second sheet detector 140, the first sheet detector 130 and the second sheet detector 140 detect the presence of the sheet S. Thereby, as shown in FIG. 6A, the control of the controller 150 causes the pressing plate 123 to enter into the insertion part 100A.

Figure 6B:
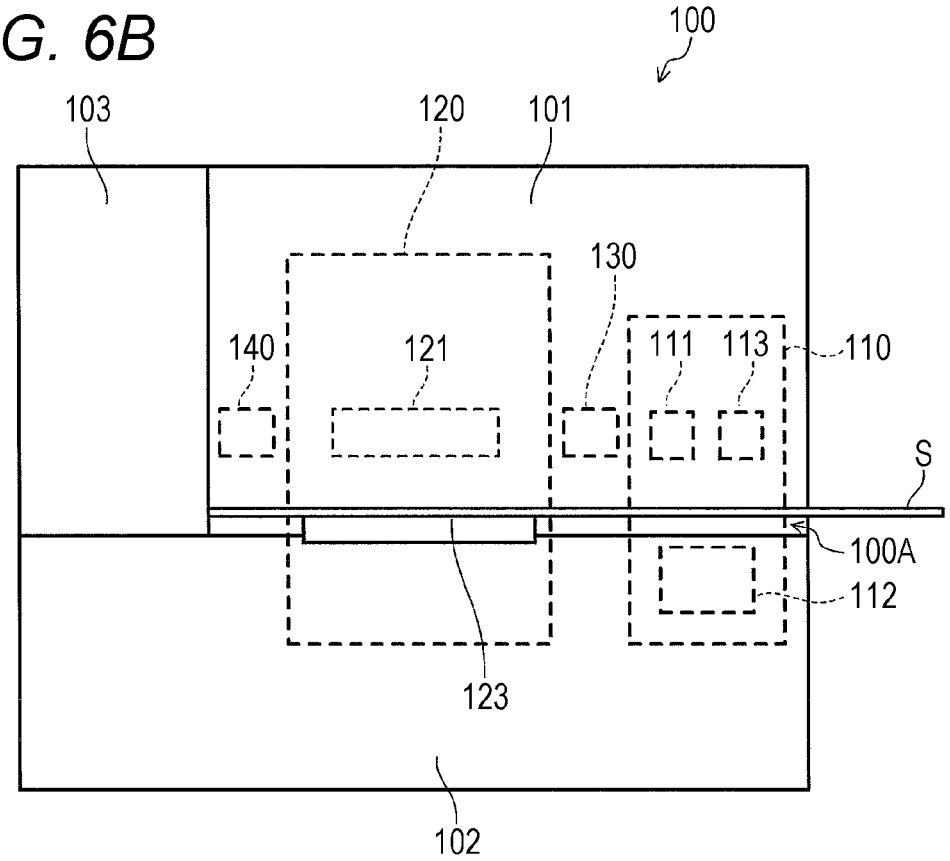
FIG. 6B is a diagram for explaining the operation of the physical property detecting device according to one or more embodiments.

Then, as shown in FIG. 6B, the sheet S is nipped between the pressing plate 123 and the upper side 101. After the sheet S is nipped, the control of the controller 150 causes the surface property detector 121 of the second physical property detector 120 to start detection.

Figure 7:
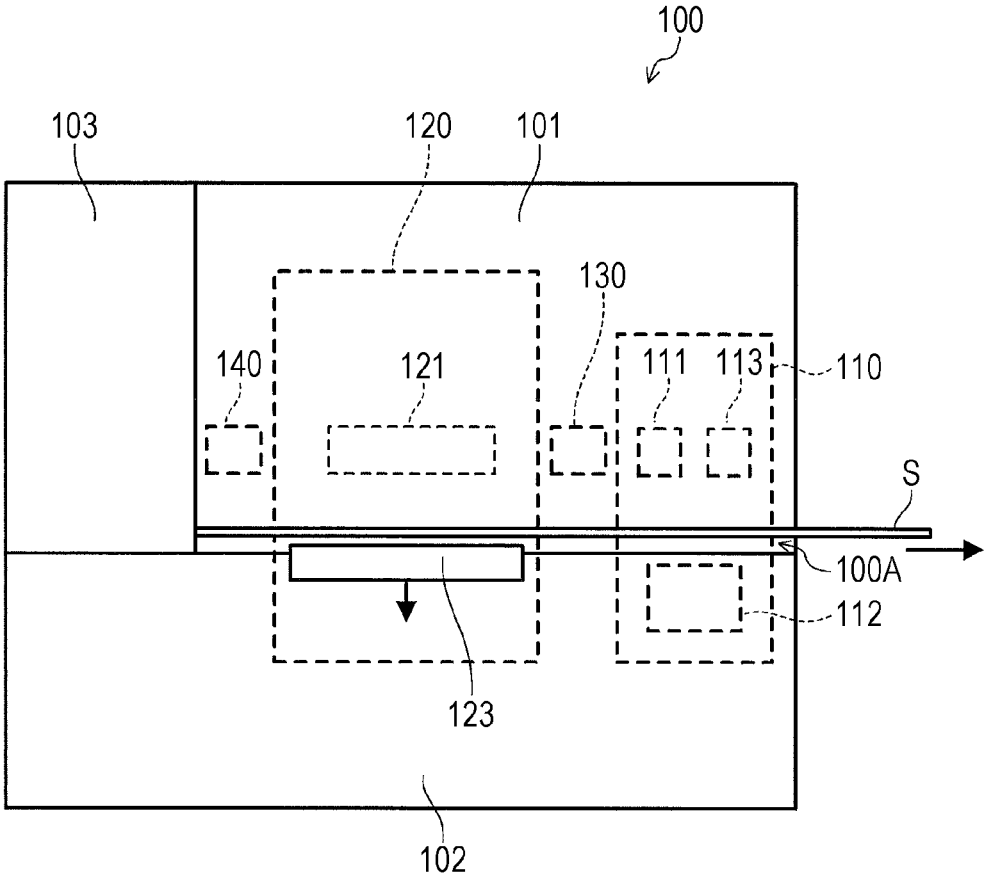
FIG. 7 is a diagram for explaining the operation of the physical property detecting device according to one or more embodiments.

After the detection by the first physical property detector 110 reaches a predetermined number of times, as illustrated in FIG. 7, the pressing plate 123 moves to a position retracted from the insertion part 100A under the control of the controller 150, and it becomes possible to pull out the sheet S from the physical property detecting device 100.

Figure 8:
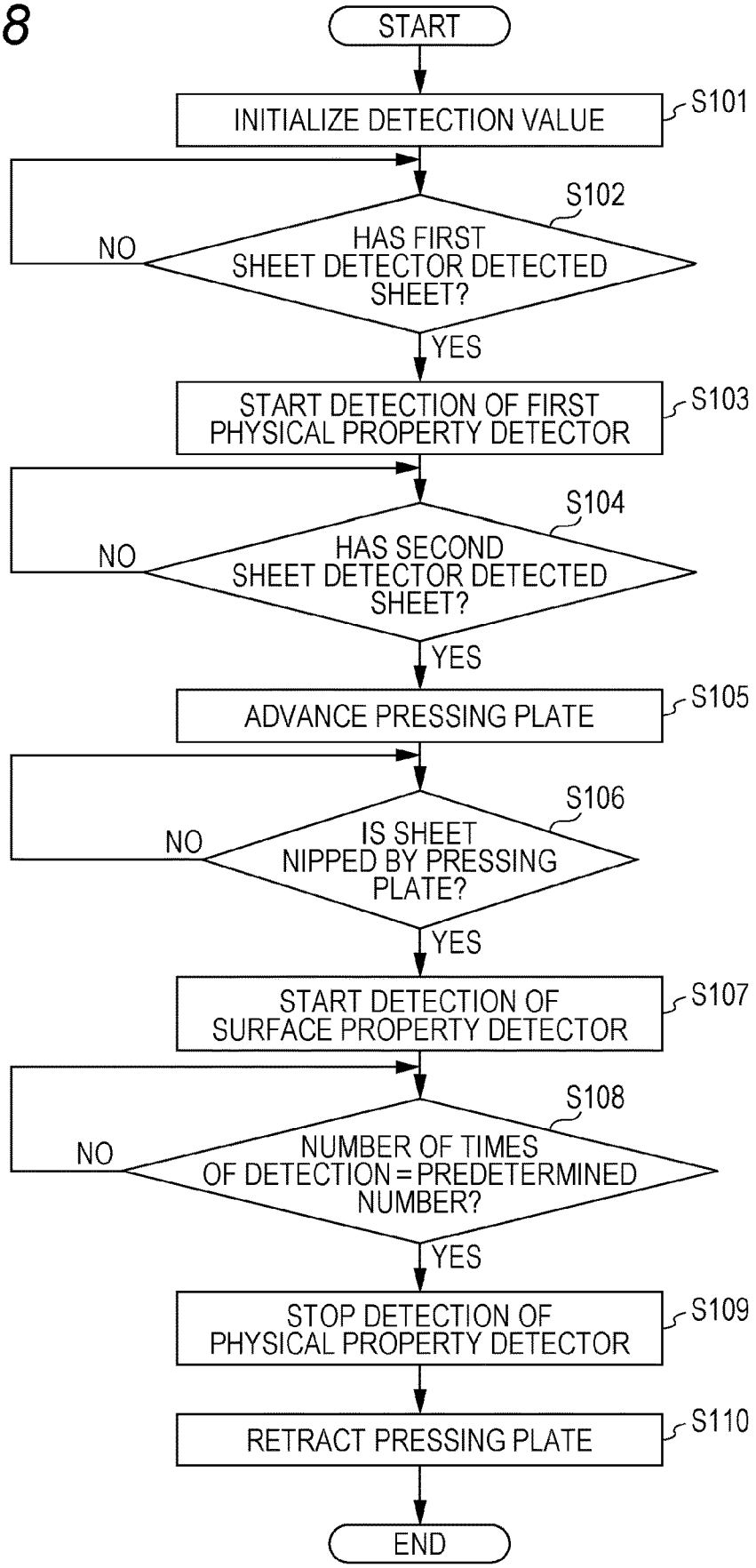
FIG. 8 is a flowchart showing an operation example of physical property detection control in a controller according to one or more embodiments.

Next, an operation example when the physical property detection control in the controller 150 is performed will be described. FIG. 8 is a flowchart showing an operation example of physical property detection control in the controller 150. The processing in FIG. 8 is appropriately executed, for example, when the physical property detecting device 100 is powered on or after the sheet S whose physical property has been detected is pulled out from the physical property detecting device 100.

As shown in FIG. 8, the controller 150 initializes detection values of physical properties stored in a storage part or the like (not shown) (step S101). The detection values are detection values detected by the first physical property detector 110 and the second physical property detector 120 before step S101.

Next, the controller 150 determines whether the first sheet detector 130 has detected the sheet S (step S102). If it is determined that the first sheet detector 130 has not detected the sheet S (NO in step S102), the process in step S102 is repeated. On the other hand, when the first sheet detector 130 has detected the sheet S (YES in step S102), the controller 150 controls to start the detection of the first physical property detector 110 (step S103).

Next, the controller 150 determines whether the second sheet detector 140 has detected the sheet S (step S104). If it is determined that the second sheet detector 140 has not detected the sheet S (NO in step S104), the process of step S104 is repeated. On the other hand, when the second sheet detector 140 has detected the sheet S (YES in step S104), the controller 150 performs control to advance the pressing plate 123 to the insertion part 100A (step S105).

Next, the controller 150 determines whether the sheet S is nipped by the pressing plate 123 (step S106). The determination criterion as to whether the sheet S is nipped by the pressing plate 123 may be, for example, the fact that the pressing plate 123 has reached the highest position or the time elapsed from the retracted position until reaching the highest position.

As a result of the determination, when the sheet S is not nipped by the pressing plate 123 (NO in step S106), the process of step S106 is repeated. On the other hand, when the sheet S is nipped by the pressing plate 123 (YES in step S106), the controller 150 performs control to start detection of the surface property detector 121 (step S107). The detection by the thickness detector 122 is performed while the sheet S passes through the portion of the thickness detector 122.

Next, the controller 150 determines whether the number of times of detection by the first physical property detector 110 has reached a predetermined number (step S108). As a result of the determination, when the number of times of detection has not reached the predetermined number of times (NO in step S108), the process of step S108 is repeated. On the other hand, when the number of times of detection has reached the predetermined number of times (YES in step S108), the controller 150 stops the detection of the first physical property detector 110 and the second physical property detector 120 (step S109).

Next, the controller 150 stops the detection by the surface property detector 121 and performs control to retract the pressing plate 123 (step S110). Thus, the sheet S can be pulled out of the physical property detecting device 100. After step S110, the present control ends. The detection results of the first physical property detector 110 and the second physical property detector 120 are stored in the storage part or the like at an appropriate timing, or transmitted to the image forming device 20 at an appropriate timing.

According to one or more embodiments configured as described above, since the first physical property detector 110 and the second physical property detector 120 are respectively disposed at different positions in the insertion and removal direction, the physical properties of the sheet S can be detected separately by the respective detectors. Therefore, the detection accuracy of the physical properties of the sheet S can be improved as compared with the configuration in which the physical properties of the sheet S are detected by one physical property detector.

In addition, since the first physical property detector 110 can detect the physical properties of the sheet S in a state of not nipping the sheet S, the sheet S when the sheet S passes through the portion of the first physical property detector 110 in the insertion part 100A can move smoothly. Therefore, the user's workability can be improved.

In addition, since the sheet S is moved when the pressing plate 123 of the second physical property detector 120 is retracted, the sheet S can be moved smoothly as compared with the configuration in which the sheet S is always nipped by the pressing plate 123. As a result, the user's workability can be improved.

That is, in one or more embodiments, it is possible to improve the user's workability and the detection accuracy of the physical properties of the sheet.

In addition, since the first physical property detector 110 is located closer to the insertion port than the second physical property detector 120, the physical properties of the sheet S can be detected by the first physical property detector 110 also while the sheet S is moved further to the back than the first physical property detector 110. That is, the detection time of the physical properties of the sheet S by the first physical property detector 110 can be extended. In addition, since the physical properties of the sheet S can be detected by the first physical property detector 110 also while the sheet S is being moved, the detection efficiency can be improved.

In addition, since detection of the first physical property detector 110 is started based on the detection result of the first sheet detector 130, the detection can be started when the physical properties of the sheet S can be detected by the first physical property detector 110. Therefore, the detection accuracy in the first physical property detector 110 can be improved.

Further, when the presence of the sheet S is not detected by the first sheet detector 130, the detection by the first physical property detector 110 is not started, and therefore it is possible to suppress the wasteful operation of the first physical property detector 110.

Further, detection of the surface property detector 121 is started based on the detection results of the first sheet detector 130 and the second physical property detector 120, and therefore it is possible to start the detection when the physical properties of the sheet S can be detected by the surface property detector 121. Therefore, detection accuracy in the second physical property detector 120 can be improved.

Further, when at least one of the first sheet detector 130 and the second sheet detector 140 does not detect the presence of the sheet S, detection by the surface property detector 121 is not started, and therefore it is possible to suppress the wasteful control, such as operating the pressing plate 123.

In addition, since the physical properties of the sheet S are detected when the presence of the sheet S is detected by the first sheet detector 130 and the second sheet detector 140, the physical properties of the sheet S can be detected when the sheet S is reliably located in the detection range. As a result, since the user does not have to repeat the operation of inserting the sheet S, the user's operation burden can be reduced.

In the above-described embodiments, the first physical property detector 110 is disposed closer to the insertion port of the insertion part 100A than the second physical property detector 120, but the present invention is not limited to this, and the first physical property detector 110 may be disposed further to the back.

In the above embodiments, the detection of the first physical property detector 110 is started based on the detection result of the first sheet detector 130, but the present invention is not limited to this, and, for example, the detection of the first physical property detector 110 may be started based on the detection result of the second sheet detector 140.

In the above embodiments, the detection of the second physical property detector 120 is started based on the detection results of the first sheet detector 130 and the second sheet detector 140, but the present invention is not limited to this, and, for example, the detection of the second physical property detector 120 may be started based on the detection result of only the second sheet detector 140.

Furthermore, in the above embodiments, the second physical property detector 120 includes the two detectors of the surface property detector 121 and the thickness detector 122, but the present invention is not limited to this, and it may include at least one of the surface property detector 121 and the thickness detector 122.

In the above embodiments, the controller 150 also serves as the first controller, the second controller, and the determination part, but the present invention is not limited to this, and the first controller, the second controller, and the determination part may be separately provided.

Further, in the above embodiments, although the basis weight is exemplified as the first physical property, the present invention is not limited to this, and physical properties other than the basis weight may be specified as the first physical property.

Moreover, in the above embodiments, although the surface property and the thickness are exemplified as the second physical property, the present invention is not limited to this, and physical properties other than the surface property and the thickness may be specified as the second physical property.

Further, in the above embodiments, a sheet is exemplified as a sheet, but the present invention is not limited to this, and a sheet may be, for example, other than the sheet, such as a film or a cloth.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. A physical property detecting device, comprising:

an insertion part that comprises an insertion port through which a sheet is inserted and removed by an operation of a user;

a first physical property detector that detects a first physical property of the sheet in a non-nipping state; and a second physical property detector that nips the sheet and detects a second physical property of the sheet in a nipping state, wherein the first physical property detector and the second physical property detector are disposed at different positions in an insertion and removal direction of the sheet, and the first physical property detector is disposed closer to the insertion port of the insertion part than the second physical property detector.

2. The physical property detecting device according to claim 1, further comprising:

a first sheet detector that is disposed between the first physical property detector and the second physical property detector.

3. The physical property detecting device according to claim 2, further comprising:

a first hardware processor that controls the first physical property detector to start detection of the first physical property when the first sheet detector detects the sheet.

4. The physical property detecting device according to claim 2, further comprising:

a second sheet detector that is disposed on an opposite side of the insertion port across the second physical property detector.

5. The physical property detecting device according to claim 4, further comprising:

a nipping mechanism that changes a sheet state, at a position corresponding to the second physical property detector in the insertion part, between the non-nipping state and the nipping state, wherein a second hardware processor controls the nipping mechanism to change the sheet state from the non-nipping state to the nipping state when the second sheet detector detects the sheet, and the second hardware processor, after controlling the nipping mechanism to change the sheet state to the nipping state, controls the second physical property detector to start detection of the second physical property.

6. The physical property detecting device according to claim 5, wherein the second hardware processor controls the nipping mechanism to change the sheet state from the nipping state to the non-nipping state when the detection of physical properties of the sheet is completed.

7. The physical property detecting device according to claim 1, wherein the second physical property detector comprises at least one of a first detector and a second detector, the first detector detects physical properties of the sheet by nipping the sheet at a nip part in the insertion part between the first detector and a first nipping member, and the second detector detects the physical properties by nipping the sheet between a second nipping member in the insertion part and a third nipping member that advances and retracts with respect to the second nipping member.

8. The physical property detecting device according to claim 1, wherein the first physical property detector detects a basis weight of the sheet.

9. The physical property detecting device according to claim 1, wherein the second physical property detector detects at least one of a surface property and a thickness of the sheet.

10. The physical property detecting device according to claim 1, further comprising a communicator that transmits physical properties of the sheet to an image forming device.

11. The physical property detecting device according to claim 1, wherein the physical property detecting device notifies the user of a detection state of the sheet.

12. The physical property detecting device according to claim 1, further comprising a first hardware processor that determines a type of the sheet based on physical properties of the sheet.

13. An image forming system, comprising:

a physical property detecting device that detects physical properties of a sheet inserted into an insertion part that comprises an insertion port through which the sheet is inserted and removed by an operation of a user; and an image forming device that communicates with the physical property detecting device and forms an image on the sheet, wherein the physical property detecting device comprises:

a first physical property detector that detects a first physical property of the sheet in a non-nipping state; and a second physical property detector that nips the sheet and detects a second physical property of the sheet in a nipping state, the first physical property detector and the second physical property detector are disposed at different positions in an insertion and removal direction of the sheet, and the first physical property detector is disposed closer to the insertion port of the insertion part than the second physical property detector.

* * * * *